US005485925A

United States Patent [19]

Miller et al.

[11] Patent Number: 5,485,925

[45] Date of Patent: Jan. 23, 1996

[54] SYSTEM AND METHOD FOR SEPARATING RECYCLED DEBRIS

[75] Inventors: Roy R. Miller; Brian K. Clark; Fred M. Austin, all of Eugene, Oreg.

[73] Assignee: Bulk Handling Systems, Inc., Eugene, Oreg.

[21] Appl. No.: 310,265

[22] Filed: Sep. 21, 1994

[51] Int. Cl.[6] ..... B07C 5/36

[52] U.S. Cl. ..... 209/615; 209/693; 209/930

[58] Field of Search ..... 209/615, 685, 209/691–693, 930, 910; 198/550.3, 550.13, 397, 393

[56] References Cited

U.S. PATENT DOCUMENTS

| | | | |
|---|---|---|---|
| 448,394 | 3/1891 | Wheelan | 209/692 |
| 576,990 | 2/1897 | Barnes | 209/692 |
| 800,690 | 10/1905 | Stuart et al. | 209/910 X |
| 882,084 | 3/1908 | Vaudreuil | 209/693 X |
| 1,390,781 | 9/1921 | Hamacher . | |
| 2,353,941 | 7/1944 | Stebler | 209/910 X |
| 2,983,374 | 5/1961 | Engleson | 209/693 X |
| 3,055,498 | 9/1962 | Megumi | 209/693 X |
| 3,687,062 | 8/1972 | Frank . | |
| 3,749,240 | 7/1973 | Spears et al. . | |
| 3,817,458 | 6/1974 | Gilberto . | |
| 3,882,994 | 5/1975 | Mecks et al. | 198/397 |
| 3,888,351 | 6/1975 | Wilson . | |
| 3,991,907 | 11/1976 | Kull . | |
| 4,042,098 | 8/1977 | D'Agnolo et al. | 198/393 |
| 4,050,637 | 9/1977 | Eirich et al. . | |
| 4,119,024 | 10/1978 | White . | |
| 4,224,379 | 9/1980 | Ichinose . | |
| 4,232,086 | 11/1980 | Mori et al. . | |
| 4,265,170 | 5/1981 | Schulze, Jr. . | |
| 4,269,321 | 5/1981 | Ichinose . | |
| 4,338,868 | 7/1982 | Lientz . | |
| 4,370,190 | 1/1983 | Ichinose . | |
| 4,387,019 | 6/1983 | Dale et al. . | |
| 4,399,756 | 8/1983 | Lientz . | |
| 4,400,154 | 8/1983 | Lientz . | |
| 4,405,059 | 9/1983 | Kull . | |
| 4,463,844 | 8/1984 | Huffman et al. . | |
| 4,480,737 | 11/1984 | Jamochian et al. . | |
| 4,597,487 | 7/1986 | Crosby . | |
| 4,735,343 | 4/1988 | Herzog | 198/397 X |
| 4,760,925 | 8/1988 | Stehle et al. | 209/692 X |
| 4,813,618 | 3/1989 | Cullom | 209/930 X |
| 4,859,211 | 8/1989 | Moore . | |
| 4,884,700 | 12/1989 | Allgäuer et al. | 209/692 X |
| 4,909,375 | 3/1990 | Cotic et al. | 198/393 |
| 4,929,342 | 5/1990 | Johnston . | |
| 5,009,370 | 4/1991 | Mackenzie . | |
| 5,024,335 | 6/1991 | Lundell | 209/615 X |
| 5,088,625 | 2/1992 | Farber et al. . | |
| 5,101,977 | 4/1992 | Roman . | |
| 5,111,927 | 5/1992 | Schulze, Jr. . | |
| 5,230,917 | 5/1992 | Peters . | |
| 5,234,109 | 8/1993 | Pederson . | |
| 5,333,738 | 8/1994 | Fuchs et al. | 209/692 X |

FOREIGN PATENT DOCUMENTS

| | | | |
|---|---|---|---|
| 1031220 | 5/1958 | Germany | 198/550.13 |
| 4406093 | 6/1988 | U.S.S.R. | 198/550.13 |

*Primary Examiner*—D. Glenn Dayoan

*Attorney, Agent, or Firm*—Marger, Johnson, McCollom & Stolowitz

[57] ABSTRACT

A system for classifying recycled debris comprising ferrous materials, fines, non-ferrous light material and non-ferrous heavy material. The classification system is made of a hopper having an inlet, including a spillway opening defining a lowermost portion of the hopper inlet, and an outlet formed along a lower portion of the hopper and contained in a plane at an angle of about 50 degrees from horizontal. A conveyor covering the outlet includes substantially rigid cleats extending into the hopper for agitating the debris and for transporting heavy material, such as glass bottles, out of the hopper outlet. Agitation of the debris causes the heavy material to drift to the lower portion of the hopper and the light material to rise to the top portion and flow over the spillway. A second conveyor positioned beneath the spillway catches the light material and carries it to another location.

26 Claims, 3 Drawing Sheets

SYSTEM AND METHOD FOR SEPARATING RECYCLED DEBRIS

BACKGROUND OF THE INVENTION

The present invention relates to a system and method for separating recyclable material. Specifically, the present invention relates to a method and system for separating recyclable debris which includes ferrous material, fines, non-ferrous heavy material, and non-ferrous light material.

The first step in recycling is to separate the various types of materials into homogeneous fractions. The ferrous materials include tin cans and other metal materials. Glass may be present in small broken pieces, referred to as fines, or as intact bottles, referred to as non-ferrous heavy material. Aluminum cans and various forms of plastic, such as plastic containers and bottles, form the bulk of the non-ferrous light material.

The recycling industry uses a broad variety of separation techniques to separate recycled debris. Workers in the field have used both manual and automatic techniques. Manual techniques which involve human sorters are usually not cost effective. Automatic techniques which rely on sorting by fraction size, magnetic characteristics, or density for air separation have generally not been employed by industry in a manner which minimizes the need for human sorters. Those in the field have found that achieving high quality separation within reasonable cost limits proves to be an unmet need. Because municipal waste varies widely in geographical as well as daily make-up and consistency, a need remains for a uniform separation system.

One attempt at providing uniform separation of municipal waste into various fractions is described in U.S. Pat. No. 5,234,109 to Pederson. Pederson teaches a method where materials are first magnetically separated, thereafter separated by size using a vibrating screen and then air blown by a sorter so as to blow the lighter materials away from the heavier materials. The vibrating screen used by Pederson is susceptible to plugging and jamming which results in significant down time for maintenance and repairs. In addition, it requires considerable structural support, at considerable capital cost, to withstand the stresses caused by the continuous vibration. Moreover, air blowing as taught by Pederson, is an inefficient method for separating materials. It is difficult to control and produces copious amounts noise and dust, which fous machinery and causes safety and health problems for the human operators and sorters.

Thus, a need remains for a system which provides uniform separation of municipal wastes while avoiding the problems encountered by workers in the field. Accordingly, it is an object of this invention to provide such a system.

SUMMARY OF THE INVENTION

The invention concerns a system and method for classifying recycled debris post consumer containers comprising light material and heavy material. In the present application, the debris comprises post consumer containers. The apparatus comprises a hopper having a generally upwardly-directed inlet and a generally downwardly-directed outlet. A conveyor having a generally upwardly-directed surface is urged against the hopper outlet. Rigid members are mounted on the conveyor for agitating debris in the hopper and for carrying heavy material therefrom. In accordance with the method, light material flows over a spillway formed in the outlet.

The foregoing and other objects, features and advantages of the invention will become more readily apparent from the following detailed description of a preferred embodiment of the invention which proceeds with reference to the accompanying drawings.

DETAILED DESCRIPTION OF THE INVENTION

Figure 1:
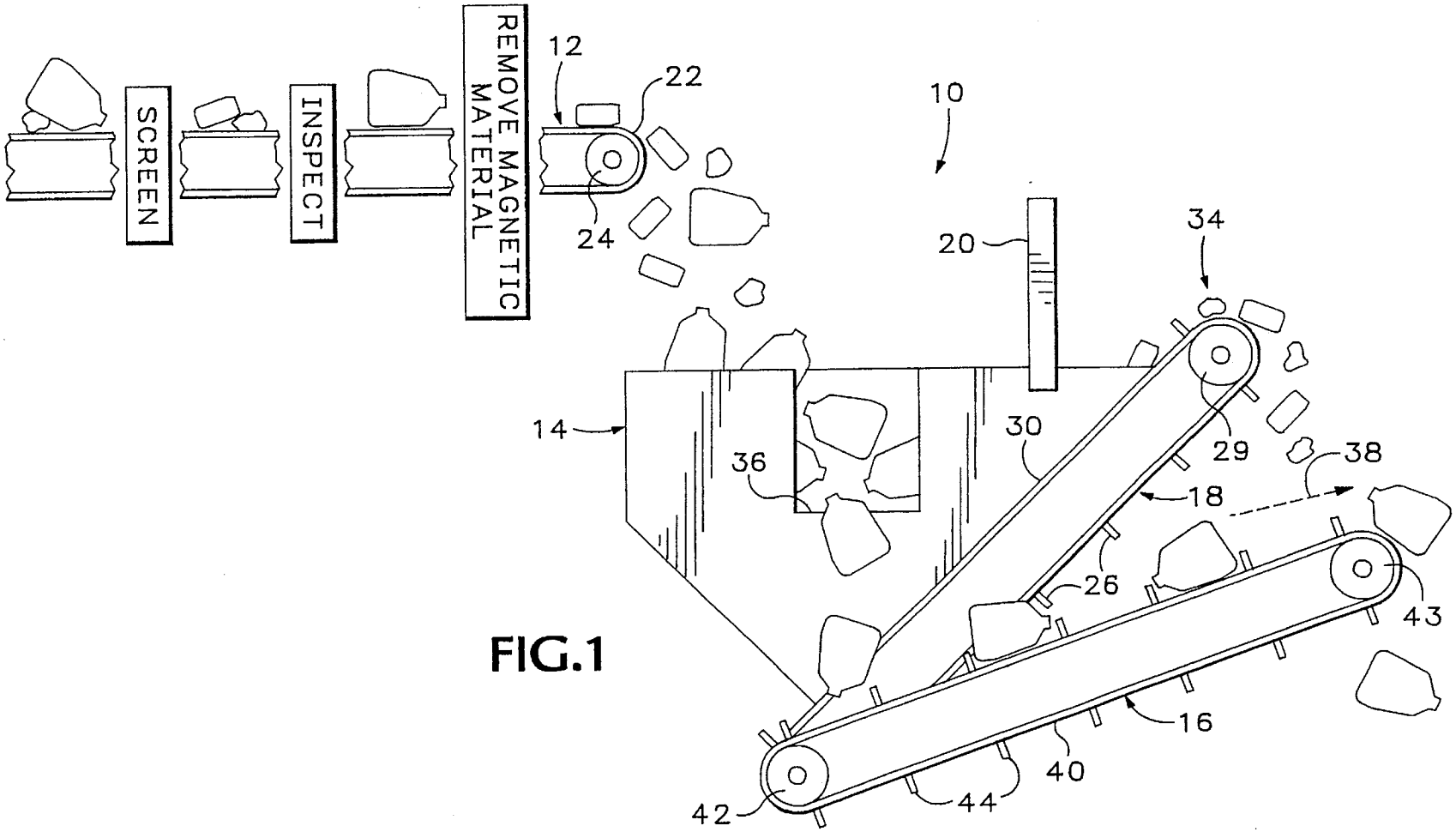
FIG. 1 is a an elevational view of a system in accordance with the subject invention.

Referring to the drawings, the numeral 10 generally designates a recyclable material separating or sorting system of the present invention. System 10 includes an inlet conveyor 12, hopper 14, first discharge conveyor 16, second discharge conveyor 18 and chain curtain 20.

Figure 2:
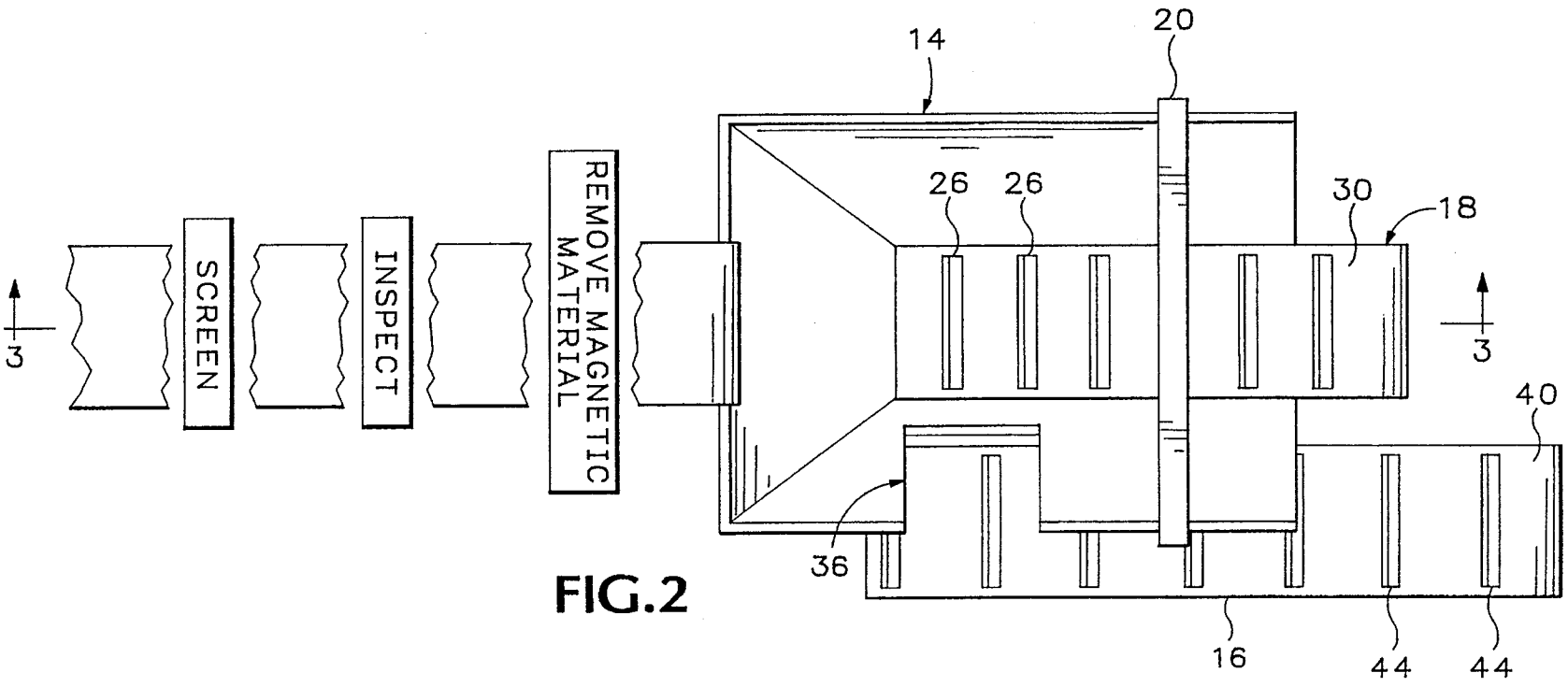
FIG. 2 is a top plan view of the system of FIG. 1.

Typically, recycled material comprise a mixture of materials including ferrous materials such as tin and steel containers and non-ferrous materials such as aluminum cans, glass and plastic bottles. Prior to being fed into system 10, the recycled material is screened, inspected, and has the ferrous, magnetic materials removed. The preliminary steps of screening, inspecting and removing the magnetic materials are well known and can be accomplished in any order. Preferably, however, as shown in FIGS. 1 and 2 the material is first screened and inspected before the magnetic materials are removed.

Those skilled in the art will appreciate that the initial step of screening can be accomplished in a variety of ways. Preferably, however, the material is initially screened to remove fines from the commingled material in a manner as described in my copending parent application, U.S. Ser. No. 08/112,411, filed Jun. 22, 1994 entitled "Method and Apparatus for Classifying Materials", which is fully incorporated herein for all purposes. Preferably, the material is screened so that particles having diameters smaller than two inches are removed from the system. Next, the screened material is visually inspected by human operators who remove any materials of improper size or composition from the commingled material. In the final preliminary step, ferrous or magnetic material is separated from the screened and inspected material. A magnet is used to accomplish the magnetic separation.

The material which has been preliminarily processed as described above is then received by inlet conveyor 12. Inlet conveyor 12 includes a rubber conveyor belt 22 extending around pulley 24. Material is conveyed along inlet conveyor 12 and is discharged into hopper 14. Second discharge conveyor 18 rotates in a clockwise manner. The upward movement of the second discharge conveyor and resulting movement of cleats 26 mechanically agitates the material which accumulates in hopper 14. This mechanical agitation fluidizes the materials and causes the heavier constituents to displace the lighter constituents and thereby concentrating the non-ferrous heavy material in a bottom fraction of hopper 14 while concentrating the non-ferrous light material in a top fraction of hopper 14.

Discharge conveyor 18 comprises belt 30, lower pulley 28, and upper pulley 29. Belt 30 extends between lower pulley 28 and upper pulley 29 and includes a discharge end 34 of discharge conveyor 18.

The speed of conveyor 18 can be adjusted depending on the constituency of the materials to be separated and the desired fractions into which the material is to be separated. Typically, the speed of conveyor 18 ranges from about 30 to 100 feet per minute (fpm). Increasing conveyor speed generally results in increased throughput while decreasing conveyor speed reduces the throughput. In general, conveyor speed is set to match the sorting capability of any human sorters who may be downstream from the system 10. An electric motor with a conventional gearbox and chain reduction (not shown) is preferably used to drive pulley 29 (in FIG. 3).

The angle of incline of discharge conveyor 18 can be adjusted to vary the degree and extent of separation. Varying the angle of the conveyor requires changing the hopper shape to maintain close proximity between the conveyor and the hopper opening adjacent thereto. For example, too steep an incline inhibits separation by not allowing the heavies constituents to advance up discharge conveyor 18. Too flat of an incline, however, will not generate sufficient mechanical agitation and fluidization to separate the heavies from the light constituents. Optimum conveyor incline (and therefore hopper outlet incline) ranges from about 35 to 55 degrees, preferably from about 40 to 50 degrees.

First discharge conveyor 16 comprises a belt 40, lower pulley 42, upper pulley 43, and cleats 44. Belt 40 extends between lower pulley 42 and upper pulley 43.

Typically, belts 30 and 40 are rubber or PVC but can be any suitable polymeric or other strong but flexible material. Cleats 26 and 44 are typically constructed out of steel or rubber but any other similar strong rigid material can also be used.

Figure 3:
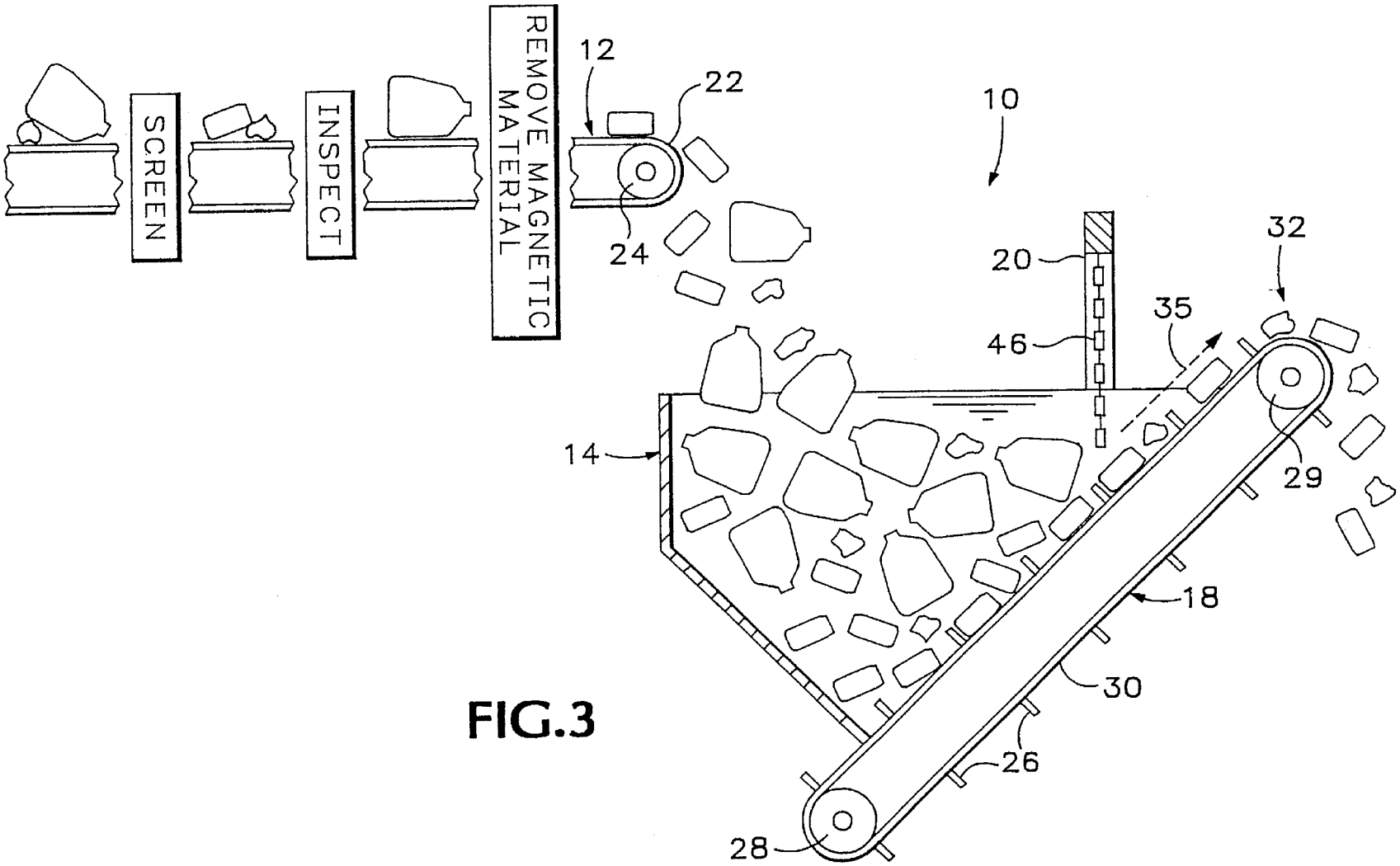
FIG. 3 is a sectional view taken substantially along line 2—2 of FIG. 2.

Cleats 26 contact the heavy fraction material and pull it upwardly on discharge conveyor 18 to produce a stream of non-ferrous heavy material as shown by directional arrow 35 (in FIG. 3). The mechanical agitation caused by cleats 26 combined with the continued input of material entering the top of the hopper 14 causes the light fraction to accumulate and exit the hopper via a spillway opening 36 onto first discharge conveyor 16 to produce a stream of non-ferrous light materials shown by directional arrow 38 (in FIG. 1).

The size of cleats 26 can also be adjusted to fit the desired throughput and degree of separation. If the cleats are too high, larger plastic bottles, for example, will be carded along with heavies fraction materials. Conversely, if the cleats are too low, they will be unable to efficiently grasp glass bottles for inclusion into the heavies fraction. In either case, an inefficient and undesired separation results. Typically, the optimum cleat height ranges from about ½ inch to 2.0 inches. Preferably, cleat height is about one inch.

Similarly, the spacing of the cleats 26 on belt 30 will affect the efficiency of the separation. If the cleats are spaced too close together, larger containers will not fit between the cleats and thus will not be carded along second discharge conveyor 18 thereby reducing the throughput and size of the heavies fraction. If the cleats are spaced too far apart, throughput is substantially reduced. Typically, cleat spacing ranges from about 10 to 18 inches apart along belt 30.

Chain screen 20 is employed to aid in the separation process. Chain screen 20 includes a series of parallel spaced chains, one of which is chain 46, which hang vertically down at an angle generally perpendicular to the upper surface of hopper 14. Chains 46 assist in the separation process by retarding the movement of larger lighter materials which may flow upwardly along conveyor 30. The skimming action of screen 20 causes larger, lighter particles to tumble back down into hopper 14. By contrast, smaller heavier materials that are being transported along discharge conveyor 18 either pass under or through screen 20 and continue to be pulled upwardly by cleats 26 along conveyor 30. The larger lighter particles which are rejected by screen 20 are mixed back into the contents of hopper 14 where the mechanical agitation of cleats 26 cause the lighter materials to be displaced by heavier materials and forces them to gradually move upwardly and to eventually exit hopper 14 via spillway opening 36.

Typically, chain screen 20 is positioned such that the distal ends of the chains 46 ranges from about 5.0 inches above belt 30 to actually contacting belt 30. Preferably, if one inch cleats are employed, the distal ends of chains 46 are positioned approximately 2.0 inches above belt 30 so that there is a 1.0 inch gap between the chains 46 and the upper ends of the cleats 26. Chain screen 20 typically comprises a plurality of link chain positioned parallel to one another across the entire width of conveyor 30. Plastic or rubber strips as well as other similar materials may be employed in place of the link chain as well.

Depending upon the composition of the recycled debris to be classified, and the sorting speed and capability of the human sorters employed, those skilled in the art will appreciate that variables such as conveyor speed, angle of incline of the inclined conveyor, distance between and size of the cleats, spillway opening placement and size, and the sizing and spacing of screen openings can be adjusted to determine the desired throughput and composition of the various material fraction streams produced by the present invention.

Having described and illustrated the principles of the invention in a preferred embodiment thereof, it should be apparent that the invention can be modified in arrangement and detail without departing from such principles. I claim all modifications and variation coming within the spirit and scope of the following claims.

We claim:

1. A system for classifying recycled debris comprising light material and heavy material, said system comprising:

a hopper for receiving such debris, said hopper having a generally upwardly-directed inlet and a generally downwardly-directed outlet;

a conveyor having a generally upwardly-directed substantially planar surface urged against said hopper outlet;

a plurality of substantially rigid members mounted on said conveyor and extending into said hopper for carrying heavy material therefrom; and a chain screen disposed over the conveyor for preventing the conveyor from carrying light material from the hopper by the conveyor.

2. The system according to claim 1 wherein the chain screen comprises a plurality of chain links positioned such that the distal ends of each link range between about 0 to 5.0 inches from the upwardly-directed surface of said conveyor.

3. The system according to claim 1 wherein a second conveyor is positioned beneath said hopper for receiving light materials flowing from said hopper inlet.

4. A system according to claim 1 wherein said rigid members are spaced from about 10 to 18 inches apart from each other.

5. A system according to claim 1 wherein said hopper inlet includes a spillway defining a lowermost portion of said inlet.

6. A system according to 1 wherein rigid members range in height from about½ inch to 2.0 inches.

7. A system according to claim 1 wherein said hopper outlet comprises an opening defined in a plane which is at an angle of between substantially 40 and 50 degrees from horizontal.

8. A system according to claim 1 wherein a substantial portion of said hopper inlet comprises an opening contained in a substantially horizontal plane.

9. A system according to claim 8 wherein said substantial portion of said hopper inlet and outlet intersect one another.

10. A system for classifying recycled debris comprising a mixture of fines, non-ferrous light material and non-ferrous heavy material, the system comprising:

means for screening the fines from said debris;

an air-filled hopper having an inlet for receiving said debris after the fines are screened therefrom;

a spillway defining a lowermost portion of said inlet; and a discharge conveyor having two ends, a first end positioned beneath the hopper in communication with the interior thereof and a second end extending generally upwardly from said first end.

11. A system according to claim 10 wherein said conveyor includes a plurality of substantially rigid members mounted on said conveyor and extending into said hopper for carrying heavy material therefrom.

12. A system according to claim 10 wherein said system further comprises means for agitating debris received in said hopper.

13. A system according to claim 12 wherein said means for agitating debris received in said hopper comprises a plurality of substantially rigid members mounted on said conveyor and extending into said hopper.

14. A system according to claim 10 wherein said hopper includes an outlet comprising an opening defined in a plane which is at an angle of between substantially 40 and 50 degrees from horizontal and wherein said conveyor includes a conveying surface positioned closely adjacent to said outlet.

15. A system according to claim 14 wherein a substantial portion of said hopper inlet comprises an opening contained in a substantially horizontal plane.

16. A system according to claim 15 wherein said substantial portion of said hopper inlet and outlet intersect one another.

17. A method for classifying recycled debris, including heavier and lighter debris, comprising the steps of:

depositing the recycled debris in an air-filled hopper having a top fraction and a bottom fraction;

moving the lighter debris from the bottom fraction to the top fraction responsive to mechanical agitation of the recycled debris;

drawing a stream of heavier debris from the bottom fraction; and drawing a stream of lighter debris from the top fraction.

18. The method of claim 17 wherein the step of moving the recycled debris comprises the step of inserting a plurality of rigid members into the debris in a generally lower portion of the hopper and pulling the members through the debris.

19. The method of claim 18 wherein the step of pulling the members through the debris comprises the step of running a conveyor upon which the rigid members are mounted.

20. The method of claim 17 wherein the step of drawing a stream of heavier debris from the bottom fraction comprises the step of running a conveyor having a generally upper surface in communication with the bottom fraction.

21. The method of claim 17 wherein the hopper includes a generally upwardly-directed inlet, and the step of drawing a stream of lighter debris from the top fraction comprises the step of depositing the recycled debris in the hopper until the lighter debris flows over the generally upwardly-directed inlet of the hopper.

22. The method of claim 17 wherein the step of drawing the stream of lighter debris from the top fraction comprises drawing the stream over a spillway disposed adjacent the top fraction of said hopper.

23. The method of claim 22 wherein the step of moving the lighter debris further comprises moving a portion of the lighter debris from a fraction beneath the level of the spillway.

24. A system for classifying recycled debris comprising light material and heavy material, said system comprising:

an air-filled container for receiving such debris, said container having a generally upwardly-directed inlet;

a conveyor disposed inside said container having a lower end in communication with the heavy material and with at least a portion of the light material and an upper end extending above the top of the container; and a plurality of substantially rigid members mounted on said conveyor for carrying heavy material therefrom.

25. The system according to claim 24 which further includes means disposed over the conveyor for preventing the conveyor from carrying light material from the container by the conveyor.

26. A system for classifying recycled debris comprising light material and heavy material, said system comprising:

a hopper for receiving such debris, said hopper having a generally upwardly-directed inlet and a generally downwardly-directed outlet;

a conveyor having a generally upwardly-directed substantially planar surface urged against said hopper outlet;

a plurality of substantially rigid members mounted on said conveyor and extending into said hopper for carrying heavy material therefrom; and means disposed over the conveyor for preventing the conveyor from carrying light material from the hopper by the conveyor.

* * * * *